US008579772B2

(12) United States Patent
Piane

(10) Patent No.: US 8,579,772 B2
(45) Date of Patent: Nov. 12, 2013

(54) DYNAMIC LOWER-BODY CONTOUR TRAINER AND EXERCISE MACHINE

(75) Inventor: Robert A. Piane, Newark, DE (US)

(73) Assignee: BVP Holdings, Inc., Newark, DE (US)

( * ) Notice: Subject to any disclaimer, the term of this patent is extended or adjusted under 35 U.S.C. 154(b) by 410 days.

(21) Appl. No.: 13/088,537

(22) Filed: Apr. 18, 2011

(65) Prior Publication Data

US 2011/0195827 A1 Aug. 11, 2011

Related U.S. Application Data

(63) Continuation-in-part of application No. 13/004,022, filed on Jan. 10, 2011.

(60) Provisional application No. 61/293,234, filed on Jan. 8, 2010, provisional application No. 61/367,538, filed on Jul. 26, 2010.

(51) Int. Cl.
*A63B 21/00* (2006.01)

(52) U.S. Cl.
USPC ..... 482/142; 482/135; 482/72; 482/74; 472/118; 472/137

(58) Field of Classification Search
USPC ..... 472/137, 118, 125; 482/15, 70, 72, 69, 482/67, 66, 907
See application file for complete search history.

(56) References Cited

U.S. PATENT DOCUMENTS

| | | | | |
|---|---|---|---|---|
| 2,977,118 | A | 3/1961 | Farkas | 482/35 |
| 5,330,398 | A | 7/1994 | Barbafieri et al. | 482/23 |
| 5,403,253 | A | 4/1995 | Gaylord | 482/43 |
| 5,518,470 | A | 5/1996 | Piaget et al. | 482/51 |
| 5,518,476 | A | 5/1996 | McLeon | 482/79 |
| 6,117,052 | A | 9/2000 | Frost et al. | 482/52 |
| 7,217,225 | B2 | 5/2007 | Husted et al. | 482/51 |
| 7,722,514 | B2 | 5/2010 | Paine, Jr. | 482/143 |
| 7,837,569 | B2 * | 11/2010 | Ouellet | 472/118 |
| 7,892,101 | B1 * | 2/2011 | Weisz et al. | 472/118 |
| 2008/0004163 | A1 | 1/2008 | Husted et al. | 482/57 |
| 2009/0017928 | A1 * | 1/2009 | Tidmarsh et al. | 472/118 |
| 2009/0036226 | A1 * | 2/2009 | Bedashyov | 472/137 |

* cited by examiner

*Primary Examiner* — Jerome W Donnelly
(74) *Attorney, Agent, or Firm* — Karl F. Milde, Jr.; Eckert Seamans Chern & Mellott, LLC

(57) ABSTRACT

An exercise apparatus for providing multi-directional training of the body of a user is disclosed. The exercise apparatus allows the a user to exercise the mid-section, hips, legs, ankles and connective tissues joining all the muscles in these areas. the apparatus comprises a support structure, two elongate foot platforms and hanging members for attaching the foot platforms to the support in such a manner that they can move in a substantially horizontal X-Y plane with two degrees of freedom. The foot platforms can be hung so that they are either arranged in parallel or have one of their ends closer together than their opposite ends. At least one substantially horizontal connecting member may be provided to interconnect the two foot platforms, either in front, in the middle or in the rear. The support structure is designed to be free standing or to be mounted onto other supporting structures.

70 Claims, 18 Drawing Sheets

DYNAMIC LOWER-BODY CONTOUR TRAINER AND EXERCISE MACHINE

CROSS-REFERENCE TO RELATED APPLICATION

This application is a continuation in-part of U.S. patent application Ser. No. 13/004,022, filed Jan. 10, 2011, entitled "MULTI-DIRECTIONAL BODY SWING TRAINER WITH INTERCHANGEABLE AND ADJUSTABLE ATTACHMENTS" which claims benefit of U.S. patent application Ser. No. 12/785,658, filed May 24, 2010 (now U.S. Pat. No. 7,914,428); U.S. patent application Ser. No. 12/287,731, filed Oct. 14, 200, (now U.S. Pat. No. 7,722,514), both of which are entitled "MULTI-DIRECTIONAL BODY SWING, TURN AND TWIST TRAINER WITH INTERCHANGEABLE AND ADJUSTABLE ATTACHMENTS", and U.S. Provisional Application No. 61/293,234, filed Jan. 8, 2010. This application also claims benefit of U.S. Provisional Patent Application No. 61/367,538, filed Jul. 26, 2010, entitled "LOW IMPACT DYNAMIC SWING EXERCISE EQUIPMENT".

FIELD OF INVENTION

The present invention relates to an exercise apparatus and more specifically to a multi-attachment exercise apparatus with adjustable parts for multi-directional training of the user.

BACKGROUND OF THE INVENTION

The human body moves in multi-planar directions and incorporates multitude of muscles all working in combination simultaneously in almost all aspects of life. Strength, mobility, flexibility, cardio-conditioning, balance, muscle awareness and coordination are all important during daily life particularly in the area of sports conditioning and movement but also in normal human activities found in everyday life like loading groceries into a car, walking the dog on a slippery sidewalk in the snow, raking leaves, etc. Existing exercise devices do not allow the user to train all these aspects simultaneously even though we live in a world that requires such skills.

Existing swing training fitness devices are designed to simulate the walking patterns of user. They are limited in their functionality and are usually fixed in a single use design. They swing forward and backward in an arced path, with the user standing on two pedals attached to two solid bars with a pivot point at about waist height and usually with the other end of each bar above the pivot point for the user to hold onto. As the user swings each leg alternatively forward and backward they stimulate a walking pattern. Such a device can be used for a cardio exercise but it provides very limited strength to the user. Exercises particularly in the mid-section, hips, legs, ankles and the connective tissues joining all of muscles in these areas are not provided by the existing fitness devices.

SUMMARY OF THE INVENTION

The present invention provides an exercise apparatus for allowing multi-planar and multi-directional training to the body of a user, wherein the exercise apparatus comprises a supporting frame, a plurality of foot platforms and means for attaching the foot platforms to the frame.

It is an object of the present invention to provide an exercise apparatus of this type which allows a user to exercise mid-section, hips, legs, ankles and the connective tissues joining all of the muscles in these areas.

It is further an object of the present invention to provide an exercise apparatus to allow for training and coordination of the mid-section, hips, legs, ankles with the upper body of the user for better strength, mobility, flexibility, cardio-conditioning, balance, muscle awareness and coordination.

It is further an object of the present invention to provide an exercise apparatus to allow rotational and multi-directional ankle training.

It is further an object of the present invention to provide an exercise apparatus which can be mounted on devices having attaching means for a supporting frame.

It is further an object of the present invention to provide a supporting frame upon which an exercise apparatus can be mounted thereby making it a stand-alone product.

It is further an object of the present invention to provide an exercise apparatus which has multiple interchangeable parts, attachments and accessories allowing for various upper and lower body applications to be performed.

These objects, as well as other objects which will become apparent from the discussion that follows, are achieved, in accordance with the present invention by providing an exercise apparatus which comprises:

a support having a plurality of connecting points;

two foot platforms adapted to be attached to, and hang from, the connecting points in a side by side arrangement to support a user; and at least one vertical elongate hanging member, connecting each of the foot platforms to at least one of the connecting points on the support, allowing for movement of the foot platforms in a substantially horizontal X-Y plane with at least two degrees of freedom.

According to one aspect of the invention, the foot platforms are elongate and hung so that they are either arranged in parallel or have one of their ends closer together than their opposite ends.

According to another aspect of the invention, the foot platforms are hung with one of their ends higher or lower than their opposite ends.

According to still another aspect of the invention, at least one substantially horizontal connecting member is provided to interconnect the two foot platforms together, either in front, in the middle or in the rear.

The support structure is designed to be free standing or to be mounted onto other supporting structures. It is preferably provided with a series of connecting points for each hanging member so that the user can select the positions of the foot platforms by selecting the connecting points to which the respective hanging members are attached.

The foregoing and other objects, features and advantages of the invention will be apparent from the following more particular description of the invention as illustrated in the accompanying drawings.

BRIEF DESCRIPTION OF DRAWINGS

FIG. 1, comprising

FIG. 2, comprising

FIG. 4, comprising

FIG. 5, comprising

FIG. 6, comprising

FIG. 7, comprising

FIG. 8, comprising

DETAILED DESCRIPTION OF THE PREFERRED EMBODIMENTS

Figure 1A:
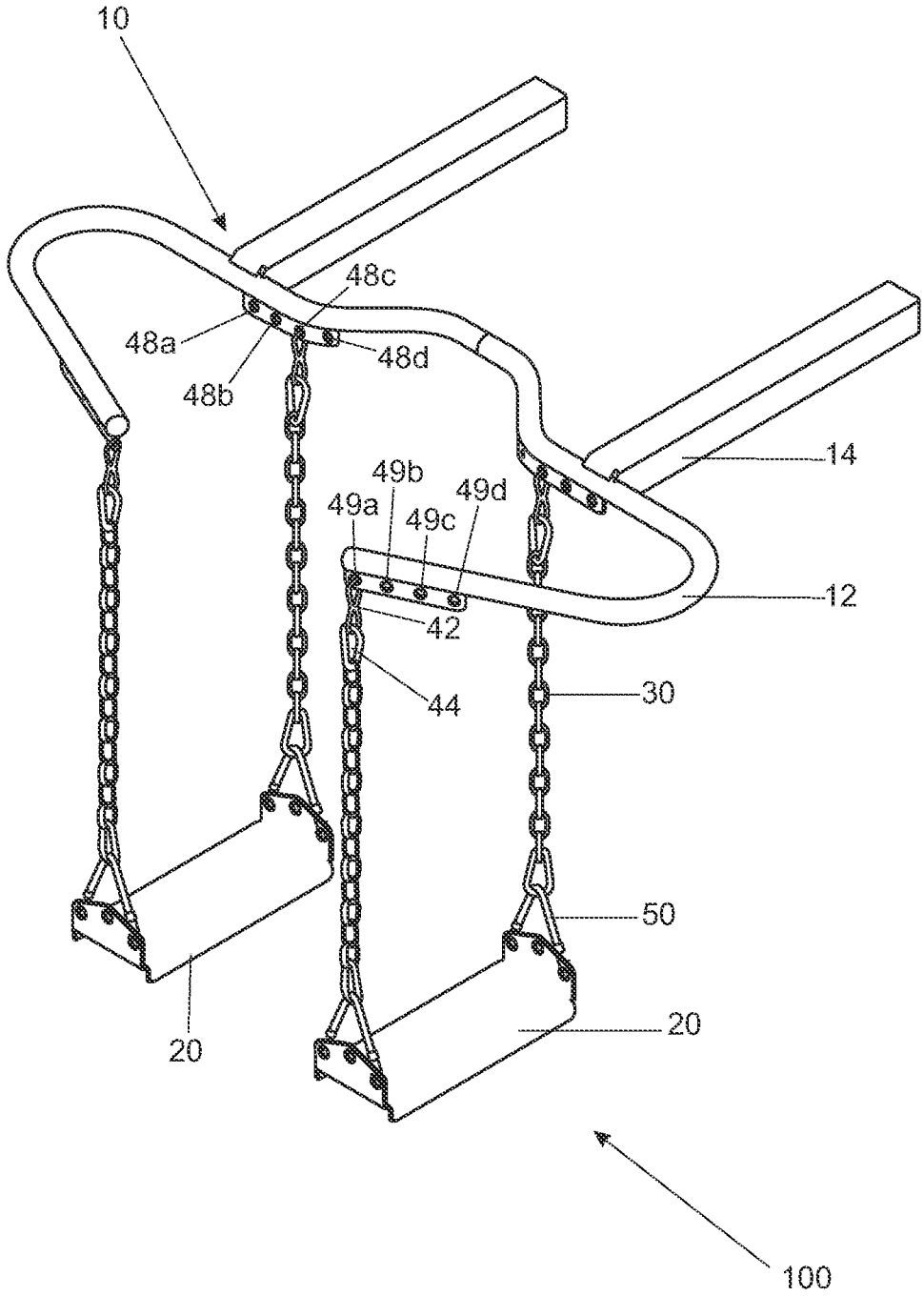
FIGS. 1*a*-1*d*, depict the exercise apparatus 100, according to a preferred embodiment of the present invention, with its basic parts.

The preferred embodiments of the present invention will now be described with reference to FIGS. 1-8 of the drawings. Identical elements in the various figures are designated with the same reference numerals.

Embodiments of the present invention provide an exercise apparatus for multi-directional and multi-planar training of the body of the user. In the description of the present invention, numerous specific details are provided, such as examples of components and/or mechanisms, to provide a thorough understanding of the various embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

FIG. 1*a* illustrates an exercise apparatus 100 along with its various parts. The exercise apparatus 100 comprises a support frame which supports foot platforms 20 substantially in parallel by means of hanging elements 30 such as chains, cables, ropes, cords, rods or bands. The support frame comprises a C-shaped holding bar 12 and support bars 14. The holding bar 12 of the support frame is attached to the support bars 14, oriented such that the C-shaped configuration is substantially horizontal. The user steps on the foot platforms 20 and holds the holding bar 12 when commencing a workout. The support bars 14 are adapted to be attached to a mounting support, such as a wall, floor or other frame members, with the aid of mounting means. The mounting support can be a wall, or a separate stand, or any supporting frame such as a SUPER-CELL exercise system available commercially from Vortex Fitness Equipment is Wilmington, Del., USA.

The hanging elements 30 used to attach the foot platforms 20 to the holding bar 12 adapted or hinged for movement in multiple directions, allowing the foot platforms to move in a substantially horizontal X-Y plane with two degrees of freedom. This allows the user to train his/her body in multi-directional patterns for better strength, mobility, flexibility, cardio-conditioning, balance, muscle awareness and coordination. Multiple connecting points 48*a*, 48*b*, 48*c* and 48*d* in front, and 49*a*, 49*b*, 49*c* and 49*d* in the rear, arranged on strips fastened below the holding bar 12 permit adjustment of the distance between the foot platforms 20, and also permit the foot platforms to be suspended either substantially in parallel or at an angle with respect to each other (away from strictly parallel) to facilitate different training exercises, and to allow various starting positions for the feet, such as a "pigeon toed" stance and the like. The holding bar 12 has swivel snap hooks or clips 42 which are further attached to a carabiner 44 to lock the links of one end of the hanging elements 30. A snap hook or the carabiner 44 can be used to adjust the length of each respective hanging element 30 to raise or lower the ends of each foot platform separately. In this way, the foot platforms can be arranged either substantially horizontally, as shown, or with one end of one or both at a different height or level than the opposite end.

The lower ends of the hanging elements 30 can be attached directly to the foot platforms 20 or connected via bungee cords or similar elastic members 50, as shown. This gives the platforms an additional degree of freedom of movement, in the vertical or "Z" direction, enabling the user to bounce up and down. Alternatively, instead of the chain or cable 30, elastic members such as rubber bands or bungee cords can be used to connect the foot platforms 20 to the holding bar 12.

In another embodiment only the carabiner 44 can be used to lock the links of the hanging elements 30. The present invention contemplates the use of swivel snap hooks 42, whereas other types of hooks or connecting means can be used without departing from the scope of the invention.

Figure 1B:
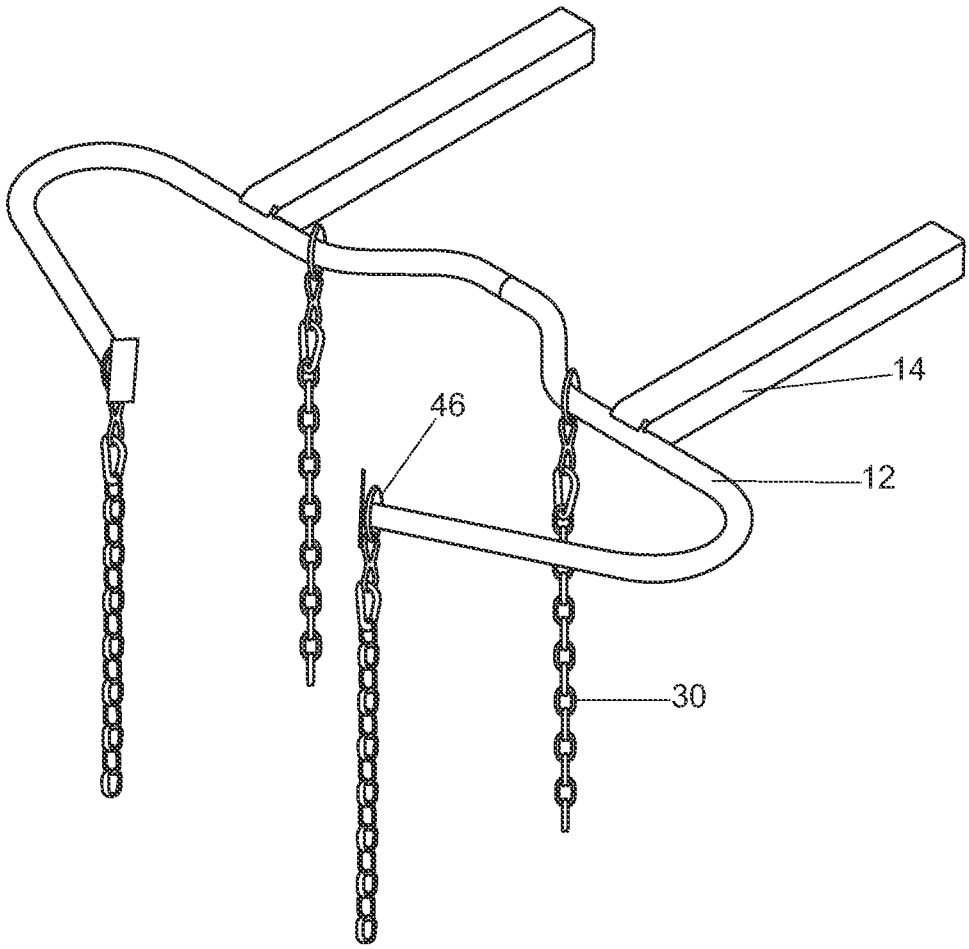

In another embodiment the hanging elements 30 are slidably attached to the support frame 10 as illustrated in FIG. 1*b*. Ring members 46 can be used to attach the hanging elements 30 to the holding bar 12, thereby allowing the user to adjust the points of attachment of the hanging elements 30 to the most comfortable position or to vary the respective distances between the front and rear ends of the platforms.

Figure 1C:
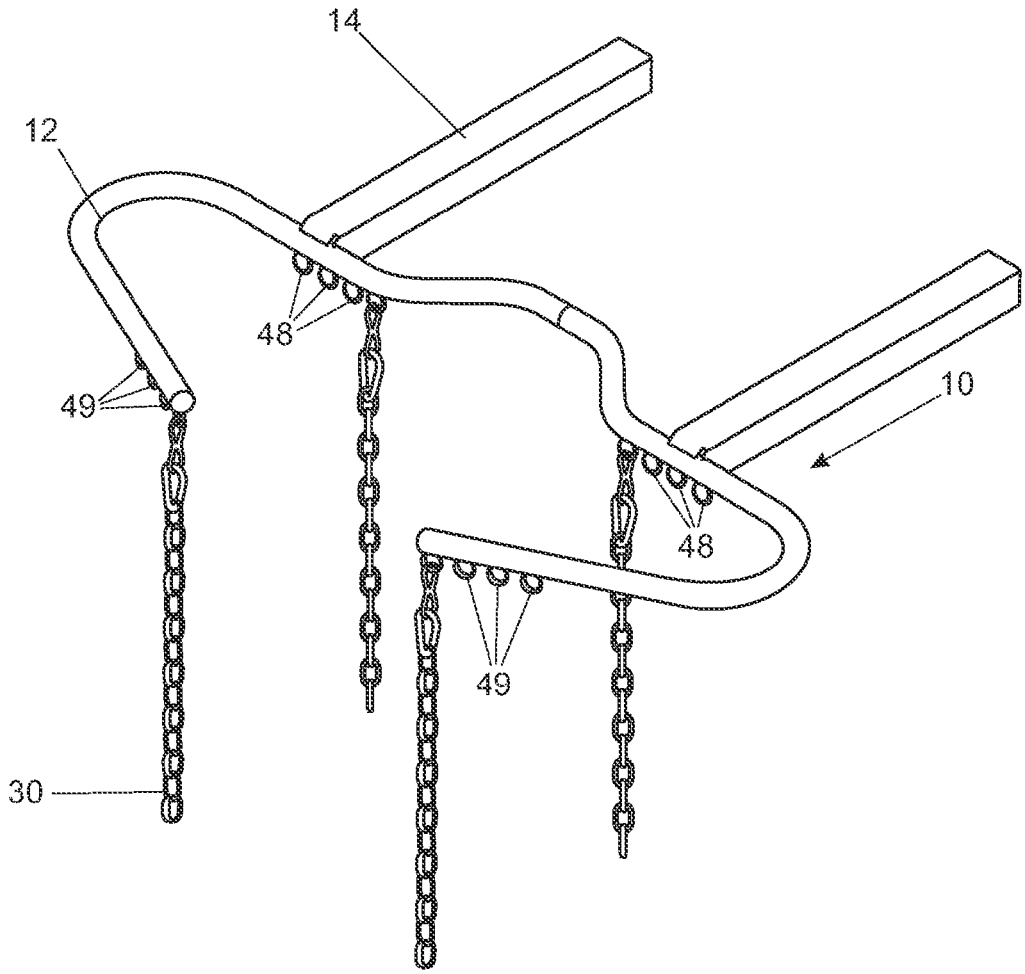

In still another embodiment, the holding bar 12 is provided with various connecting elements 48 and 49 to allow the user to attach the hanging elements 30 at specific points on the holding bar 12 as illustrated in FIG. 1*c*. Various other exercise devices can also be attached to the holding bar 12 through these multiple connecting points.

Figure 1D:
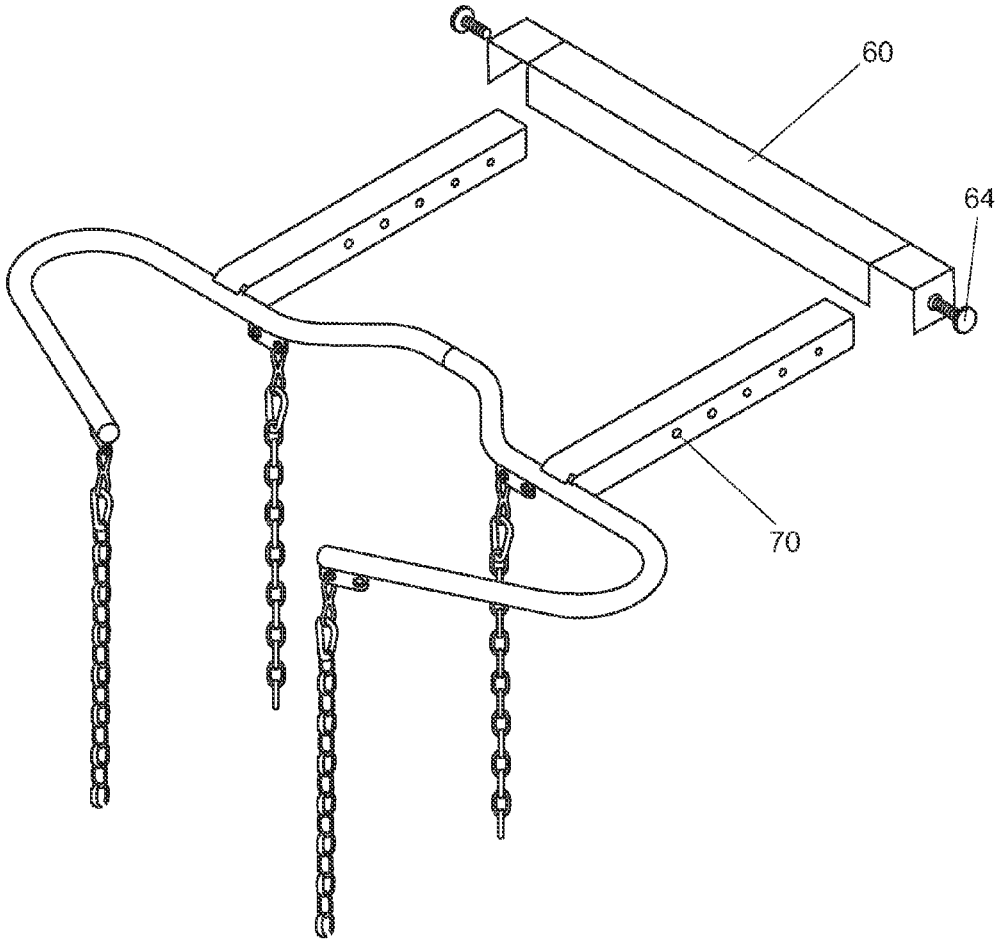

In still another embodiment, provisions 70 are made on the support bars 14 of the main frame 10 for accommodating crossbars 60 or similar structures as illustrated in FIG. 1*d*. The crossbars are affixed to the support bars by means of pop pins 64, or the like. Various accessories can be attached to the crossbars 60 to facilitate several types of workouts.

Figure 2A:
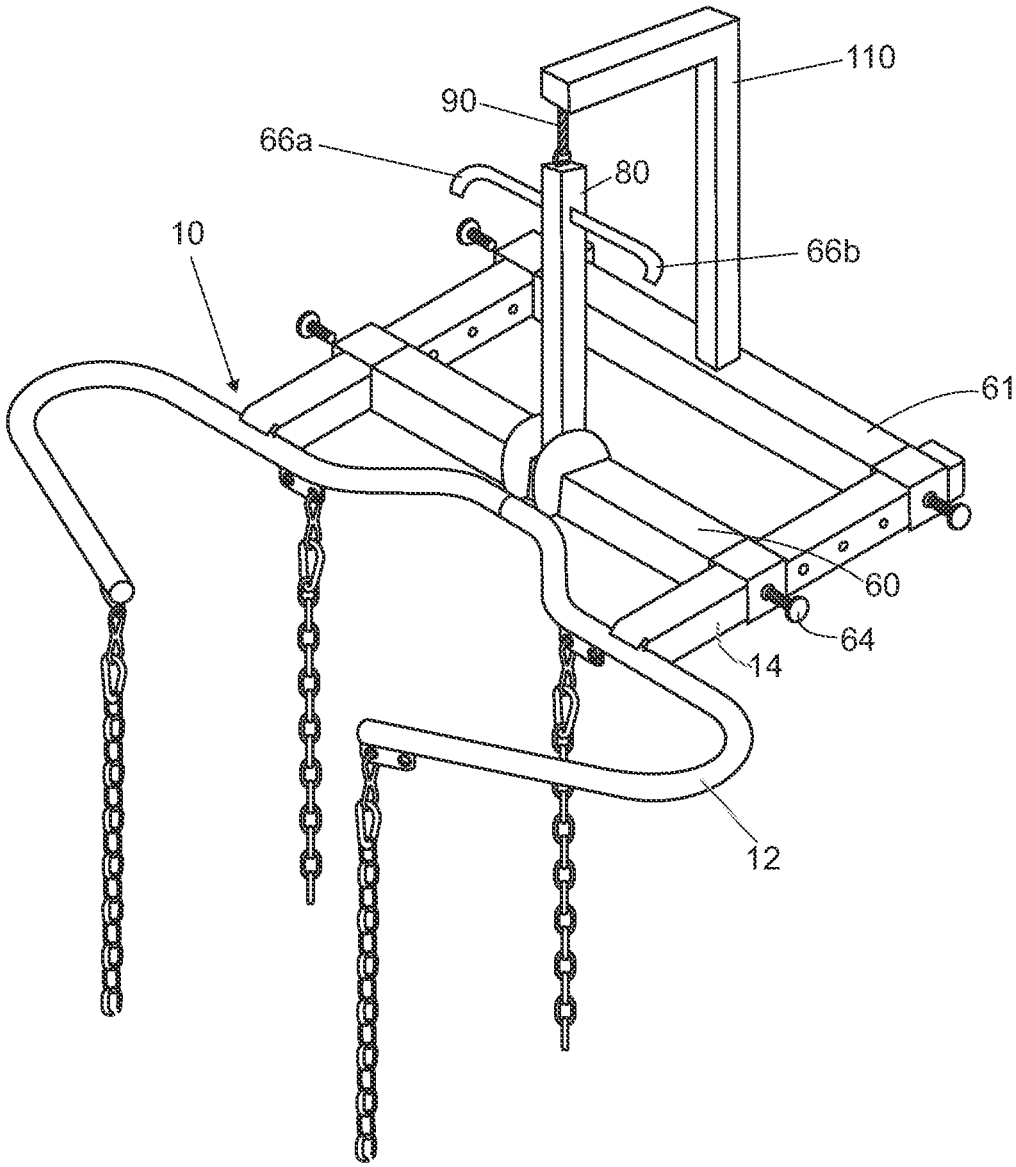
FIGS. 2*a* and 2*b*, depict the exercise apparatus 100 with an attachment for upper body workout.

One such accessory can be a detachable device for upper body training as illustrated in FIG. 2*a*. This accessory allows the user to train the upper body either in unison or in isolation to the lower body. The attachment includes two horizontal handles 66*a* and 66*b* mounted on an upright bar 80, the bottom end of which is pivotally mounted on a crossbar 60 fitted between the support bars 14 of the frame 10. The bar 80 is lockable in a fixed upright position, or in any one of several different tilted positions, but when unlocked it can tilt freely in any direction.

Figure 2B:
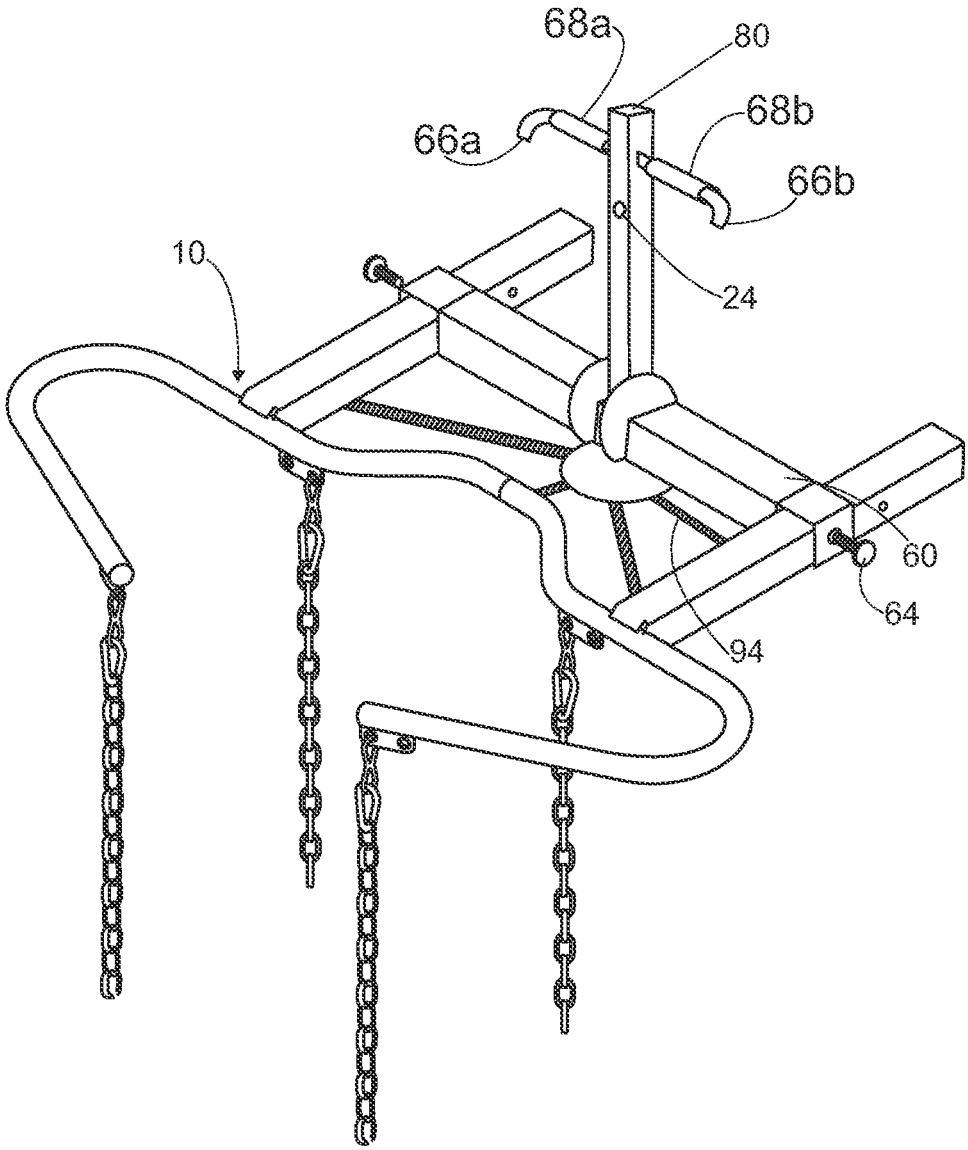

In the embodiment shown in FIG. 2*a*, an elastic member 90 is used as a means of resistance to provide resistance to tilting motion of the bar 80. One way of attaching an elastic member 90 is to connect it between the top end of the handle 80 and a post 110 attached to a second crossbar 61. Another way of providing resistance is to attach multiple elastic members 94 to the bottom of the bar 80 as shown in FIG. 2*b*. In this embodiment, one end of the elastic members is attached to the bottom end of the bar 80 and while the other end is attached at various points to the main frame 10. The bar 80, which is pivoted on the crossbar 60, can me moved in any direction away from the vertical using the handles 66*a* and 66*b*; however, it is continually biased toward the upright position by the elastic members 94. As in the case of the embodiment of FIG. 2*a*, the bar 80 in the embodiment of FIG. 2*b* can be locked in the upright position, or in one of a number of different non-upright positions as selected by the user, to prevent tilting movement.

Figure 3:
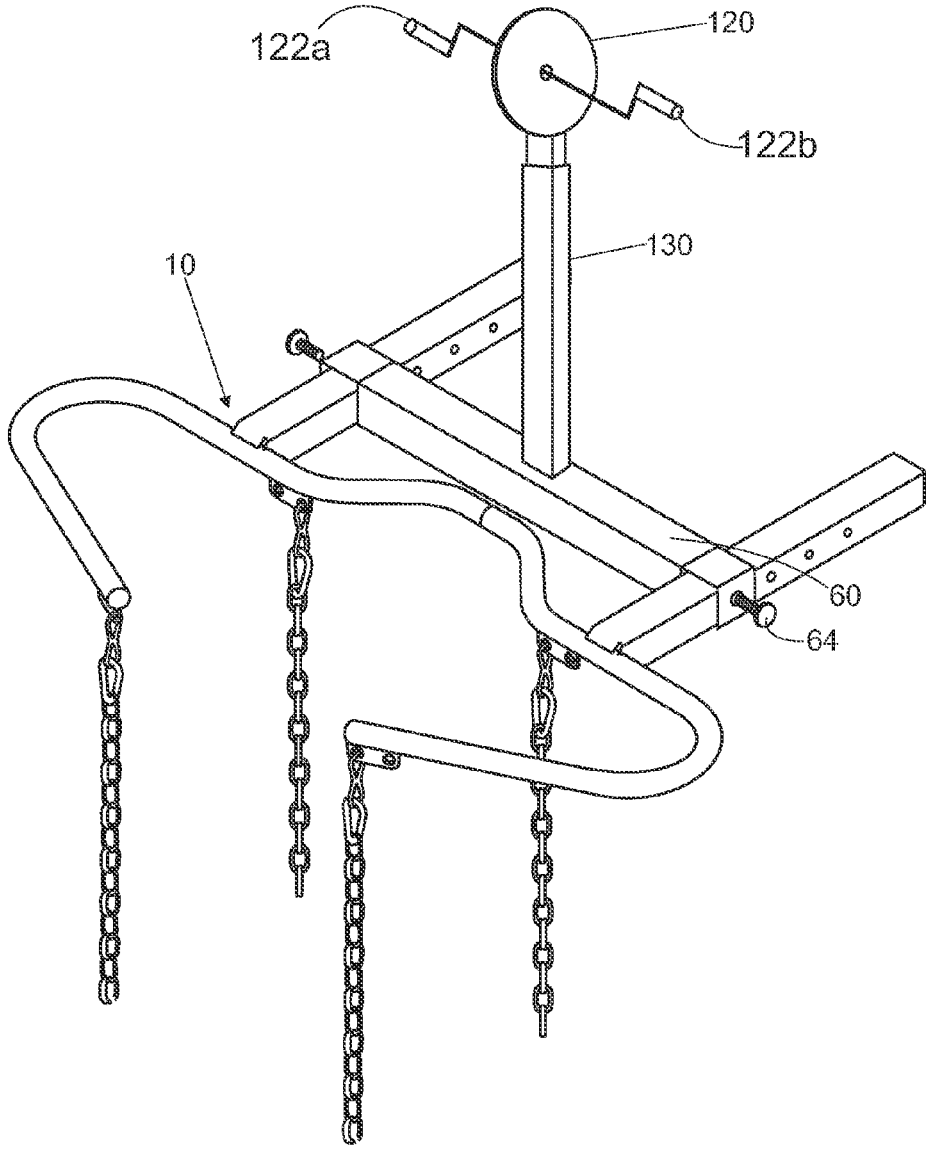
FIG. 3 depicts an upper body bicycle attachment for the exercise apparatus.

Another such upper body training accessory is a detachable exercise bicycle device 120 with an adjustable resistance to facilitate an upper body workout of the user as illustrated in FIG. 3. The hand operated bicycle device 120 is mounted on a post 130 which is attached to the crossbar 60. When coupled to a device for measuring the energy expended by the user, this type of accessory is sometimes referred to as an "ergometer."

To provide information about the use of the exercise apparatus, a number of electronic sensors may be disposed at various points on the apparatus. For example, as shown in FIG. 2*b*, metal sensors 68*a* and 68*b* may be mounted on the handles 66*a* and 66*b*, respectively, to sense the heart rate of the user. A motion sensor 24 may be mounted on the movable bar 80 to sense the position, speed and/or acceleration of the bar.

On or more such sensors 122*a* and 122*b* may also be fitted to the hand-operated bicycle device, as shown in FIG. 3, for sensing heart rate, motion, etc.

In still another embodiment, the foot platforms 20 are fitted with various accessories for ankle training in multiple directions. These accessories may be both attachable and detachable, so that the user can apply them to the foot platforms 20 whenever an ankle exercise is required.

Figure 4A:
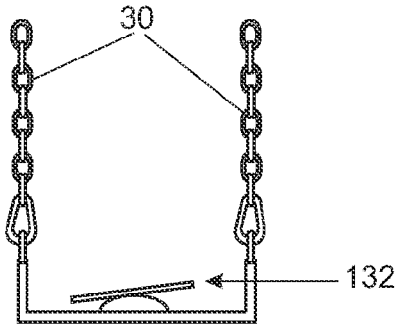
FIGS. 4*a*-4*d*, depict various attachments for the foot platforms.
Figure 4B:
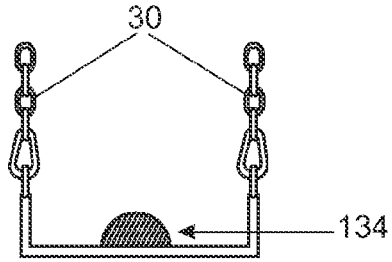
Figure 4C:
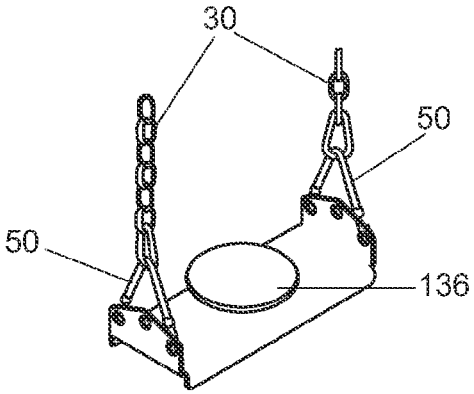

The accessory can be a pivotal circular plate 140 as shown in FIG. 4*a*. The accessory can also be a half ball 145 made up of a material such as rubber as shown in FIG. 4*b*. A rotatable disc 135 can also be used as an accessory for the foot platforms 20 for developing rotational strength of the ankle of user as shown in FIG. 4*c*. As shown in FIGS. 4*a*-4*c*, the platforms may be hung directly from non-elastic hanging members 30 or from elastic members 50, such as rubber bands or bungee cords for example, which, in turn, are connected either to the non-elastic members 30 or to the support bar 12.

Figure 4D:
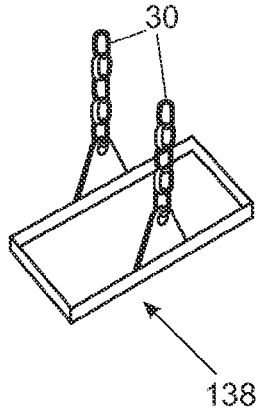

In still another embodiment, a foot platform 138 can be pivoted centrally as shown in FIG. 4*d* so that the platform will rock up and down in see-saw fashion. This extra degree of freedom, in addition to the basic two degrees of freedom afforded the foot platform by the hanging elements 30, enables the user to perform ankle training.

Figure 5A:
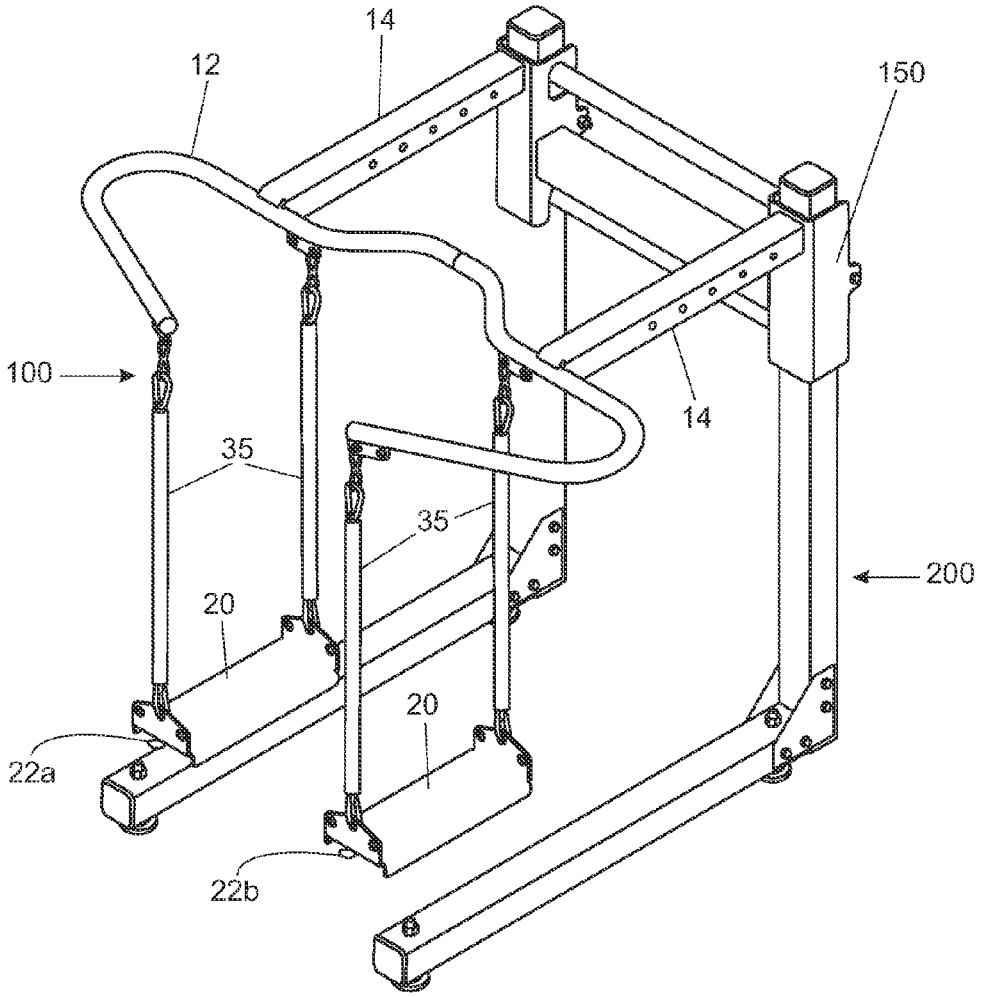
FIGS. 5*a*-5*e*, depict foot platforms with tethers for limiting their movement.
Figure 5B:
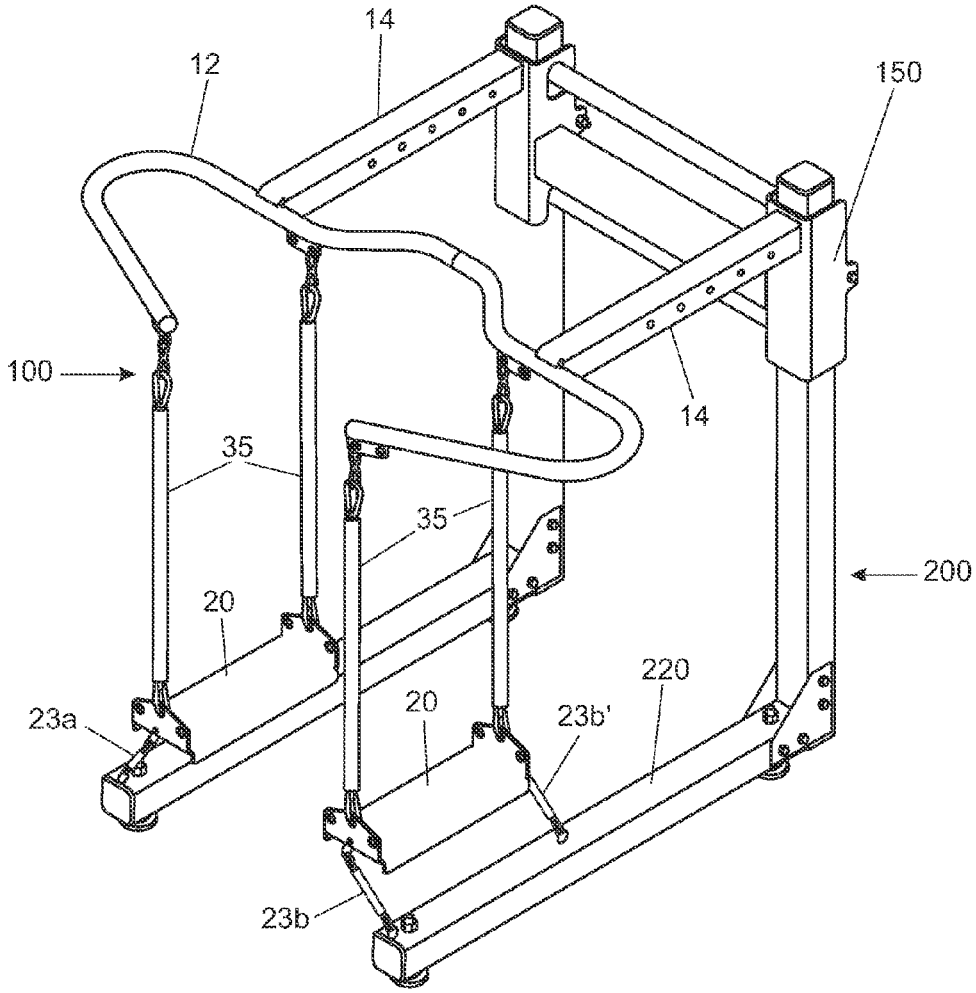

In still another embodiment, the exercise apparatus 100 is mounted on a stand 200 using a ladder hook-on assembly 150 thereby making it a stand-alone product as shown in FIG. 5*a*. The ladder hook-on assembly 150 is attached to the support bars 14 of the supporting frame of the exercise apparatus 100 as shown. Ladder hook-on assembly 150 allows for adjusting the height and position of the holding bar 12 of the exercise apparatus 100 and it can be attached or detached from the stand 200 as well as from the exercise apparatus 100 with ease.

Motion sensors 22*a* and 22*b* can be provided on the foot platforms to sense the motion imparted by the user. These and the other sensors that may be provided on the exercise apparatus are connected to an electronic system (not shown) for processing and signals and providing an image display in response to these signals.

Figure 6A:
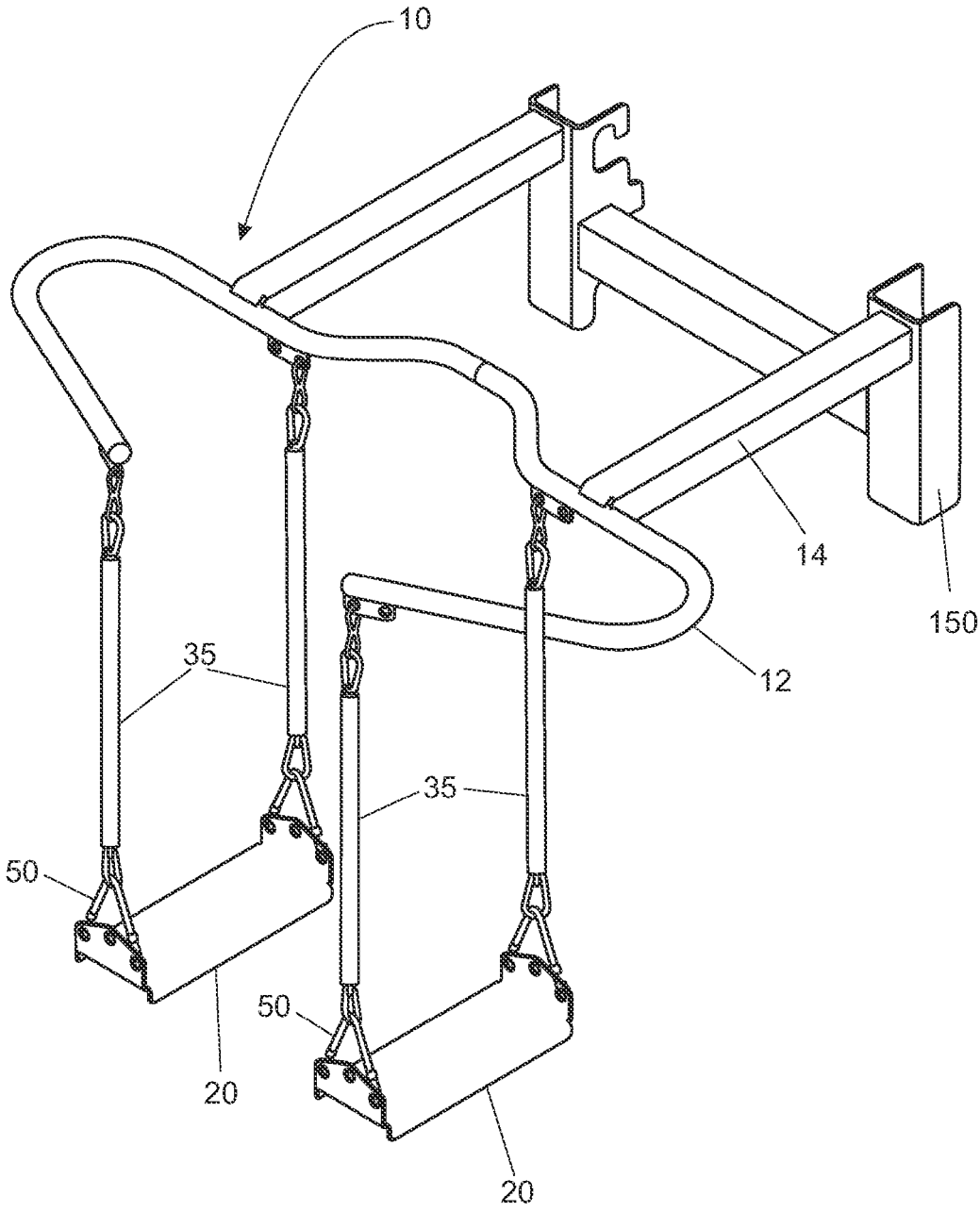
FIGS. 6*a*-6*d*, depict a stand for the exercise apparatus.

As shown in FIG. 5*a*, the foot platforms 20 can be hung from the holding bar 12 via flexible cables or ropes 35, either elastic or non-elastic, or with other types of elastic or non-elastic cables, chains or cords. The hanging members 35 can also be solid rods, provided that they are connected to the bar 12 in such a manner as to swing freely in all directions. The hanging members 35 can be attached directly to the foot platforms 20, as shown in FIG. 5*a*, or via cords 50, with may be either elastic or non-elastic, as shown in FIG. 6*a*.

FIGS. 5*b*-5*e* illustrate another embodiment of the exercise apparatus in which the left and right platforms are connected to the horizontal base members 220 via tethers 23*a* and 23*b*, respectively. These tethers, which may be connected either to the center of each platform, or to each end of each platform, as shown, prevent the platforms from moving too far apart or close together. The tethers are preferably attached by clips or rings at each end. The clips may be connected and disconnected to attach and remove the tethers from the apparatus, as desired. The clips allow for movement of the tethers with respect to the platforms and the base members at the points of connection.

The tethers 23*a* and 23*b* are preferably adjustable in length and may be rigid rods, or flexible bands, cables, chains or cords. The tethers can also be elastic bands or springs, or even a piston and cylinder arrangement that provides resistance to axial movement.

Figure 5C:
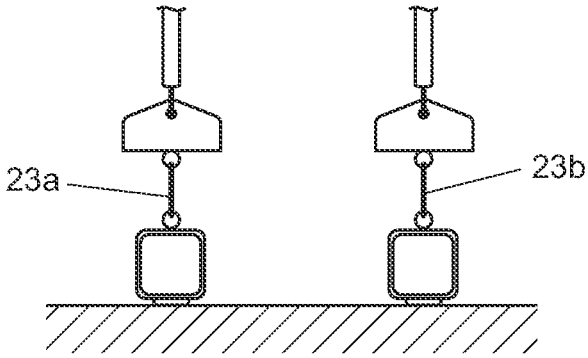
Figure 5D:
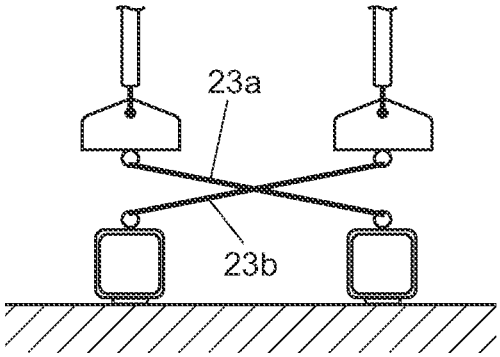
Figure 5E:
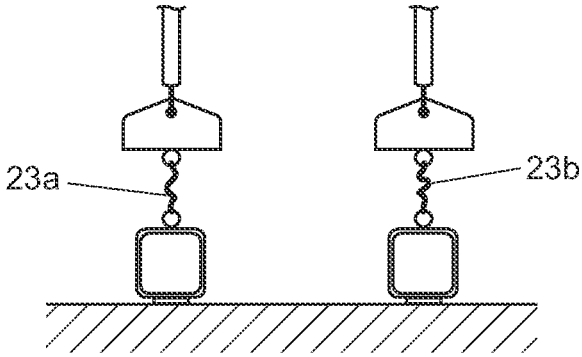

FIGS. 5*c*-5*e* show different configurations of the tethers with respect to their points of attachment. In FIG. 5C the tethers are elastic and made as short as possible to bias the platforms toward their central, default position. In FIG. 5*d* the tethers 23*a* and 23*b* are connected between a base member 220 and an opposite platform, to prevent the platforms from spreading apart. In FIG. 5*e* the tethers are longer than the distances between the base members and their respective platforms, providing slack and allowing the platforms to move horizontally right or left to a certain degree.

Figure 6B:
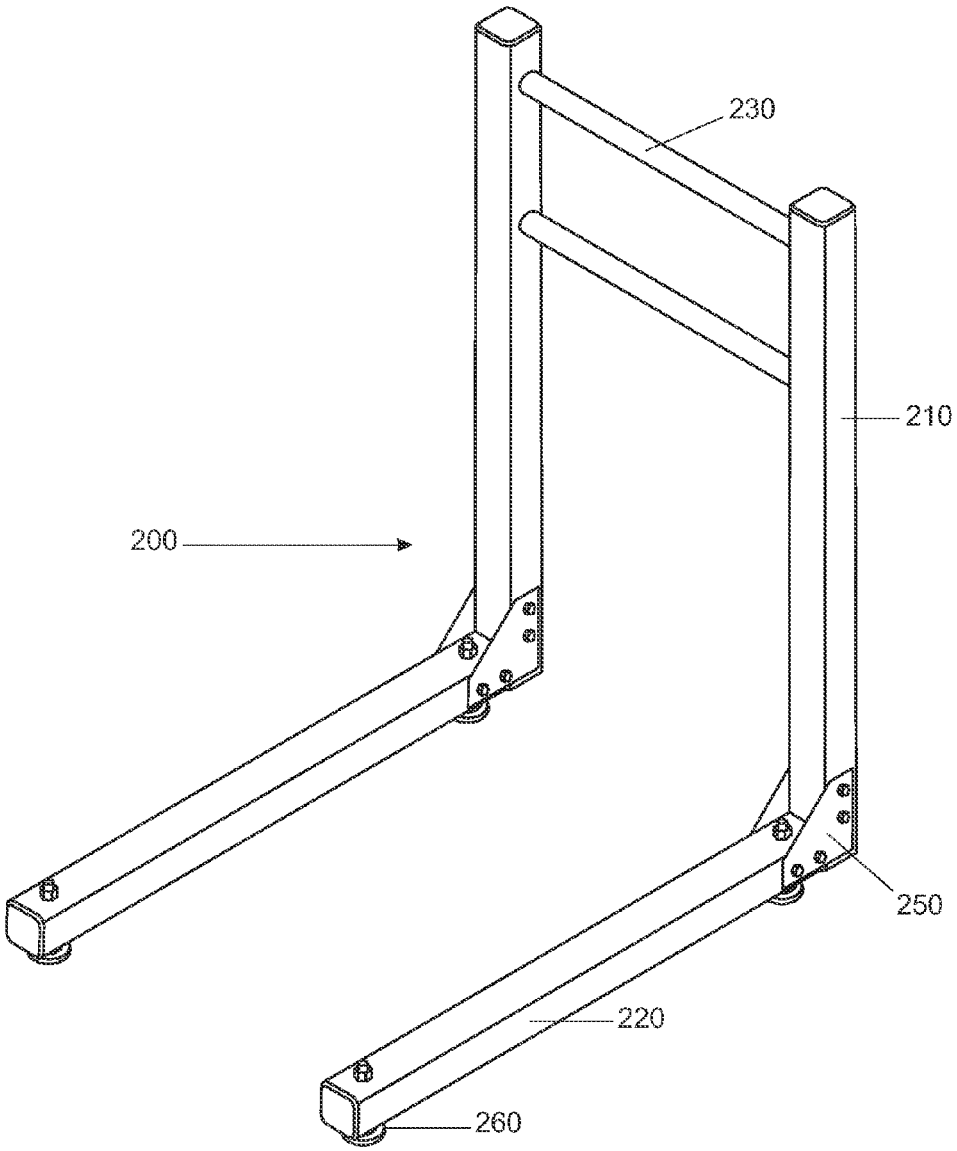
Figure 6C:
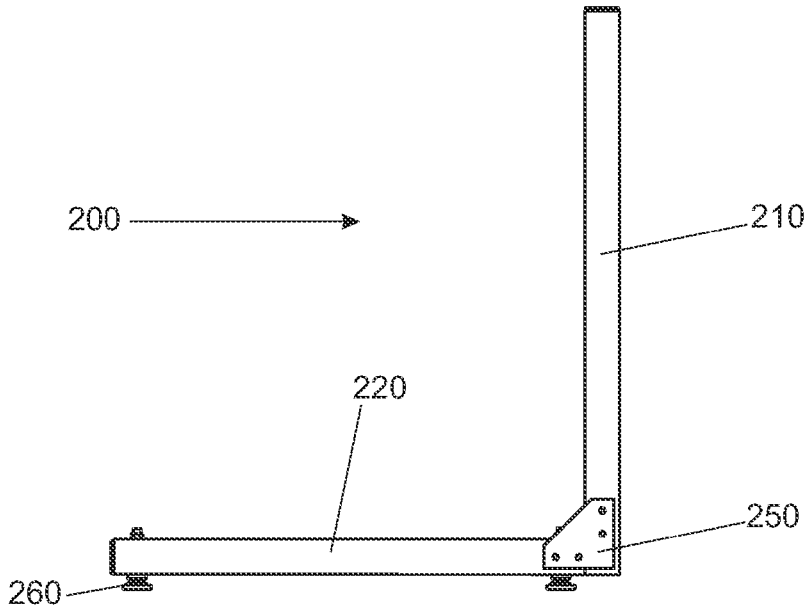
Figure 6D:
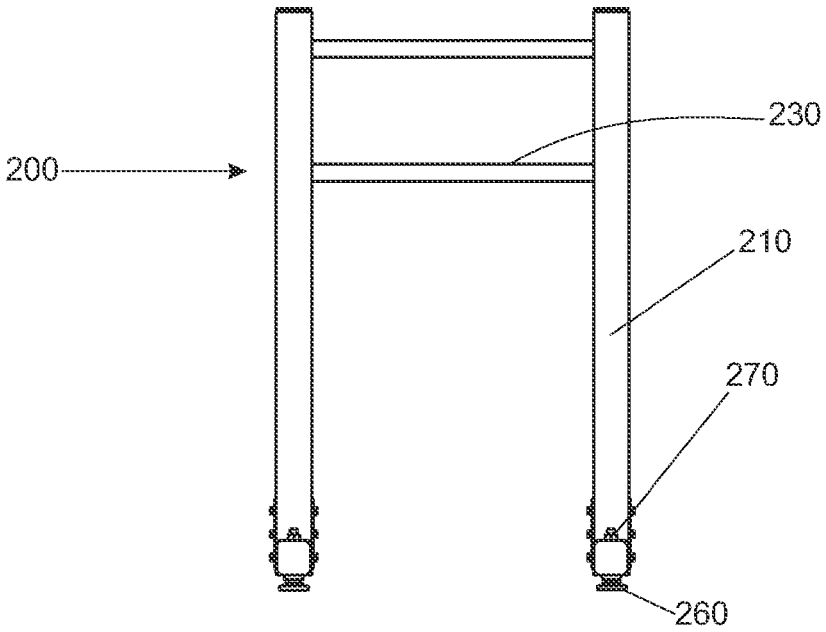

The stand 200, without the support frame, the hanging members and the foot platforms, is illustrated in FIG. 6*a*. The stand 200 has vertical members 210 which are attached to each other by crossbar 230 forming a ladder-like frame structure as shown in FIG. 6*b*. The vertical members 210 are attached to horizontal members 220 by well known means, such as gusset plates 250. The horizontal members 220 are provided with leveling feet 260 which can be adjusted to required height. The side view of the stand 200 as shown in FIG. 6*c* depicts the connection between the vertical members 210 and horizontal base members 220 by the gusset plate 250 and the arrangement of the leveling feet 260 on the base members 220. FIG. 6*d* depicts the use of hexagonal lock nuts 270 on the horizontal base members 220 in attaching the feet 260.

The exercise apparatus 100 can also be mounted on wall or any supporting structure using standard mounting means.

Figure 7A:
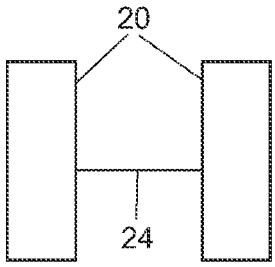
FIGS. 7*a*-7*h*, depict foot platforms of the exercise apparatus in various configurations.
Figure 7E:
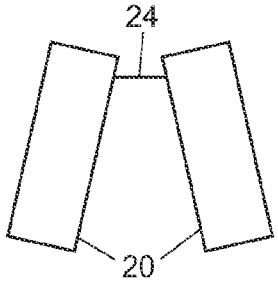
Figure 7B:
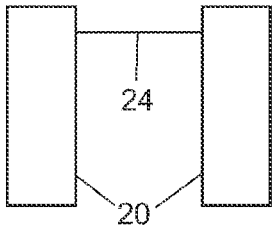
Figure 7F:
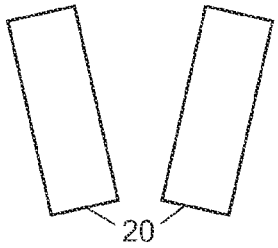
Figure 7C:
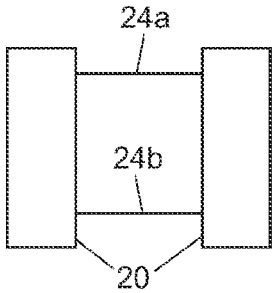
Figure 7G:
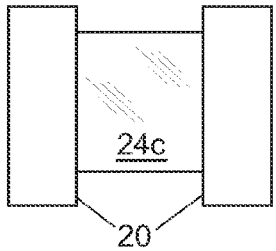
Figure 7D:
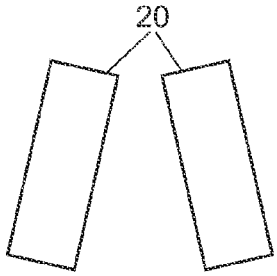
Figure 7H:
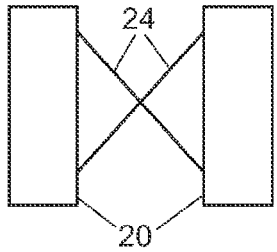

FIGS. 7*a*-7*h* show various configurations of the foot platforms 20, as they are hung in the exercise apparatus according to the present invention. In FIGS. 7*a*-7*c*, the foot platforms are arranged substantially in parallel. In FIGS. 7*d* and 7*e*, the foot platforms 20 are arranged closer together in the front than in the rear, so that when a user stands on these platforms, aligning the feed with the elongate platforms, he/she stands "pigeon toed". In FIG. 7*f*, the foot platforms 20 are arranged closer together in the rear than in the front. It will be understood that the arrangement of the platforms can be selected, and thereafter modified, by connecting the snap hooks or clips 24 to the holding bar 12 at different clip locations.

Since the hanging members are pivoted at the top, and/or are flexible in and of themselves, the user can cause the foot platforms to assume any position desired in the horizontal X-Y plane, even though their "default" position may be in parallel, as shown in FIGS. 7*a*-7*c*, 7*g* and 7*h*, or at a slant with respect to each other, as shown in FIGS. 7*d*-7*f*.

FIGS. 7*a*, 7*b*, 7*c* and 7*e* show the addition of a horizontal connecting member 24 extending between and interconnecting the two horizontal foot platforms 20. In FIG. 7*a*, the member 24 is connected to each foot platform substantially midway between its two ends. In FIGS. 7*b* and 7*e*, the member 24 connects the front portions of the two foot platforms 20, and in FIG. 7*h* the front portion of one platform is connected by a diagonal connecting element to the rear portion of the other platform. In FIG. 7*c*, two connecting members 24*a* and 24*b* interconnect both the front portions and rear portions of the two foot platforms, respectively. In FIG. 7*g*, a web of material or sheet 24*c*, which may be either rigid or elastic, extends between, and is connected to, the two foot platforms. Additional connecting members can be provided as desired.

The connecting members 24 can be flexible cords or chains or inflexible rods. In the case of flexible cords, they can be elastic, such as bungee cords, rubber bands or springs, or non-elastic, such as cables or chains. In the case of inflexible rods, they can be either rigidly connected to the foot platforms or pivotally connected, so that the foot platforms can rotate in the horizontal plane about the points of connection. Advantageously, the connecting members 24 are clipped to the foot platforms so as to permit relative movement in any direction.

Advantageously, the connecting members 24 can comprise a piston and cylinder providing at least one of hydraulic and pneumatic resistance in at least one direction. The piston and cylinder are preferably spring biased in one direction to restore the spacing between the foot platforms to a default position when the user does not apply force.

Advantageously also, the hanging members 30 and/or the connecting members 24 are adjustable in length.

Figure 8A:
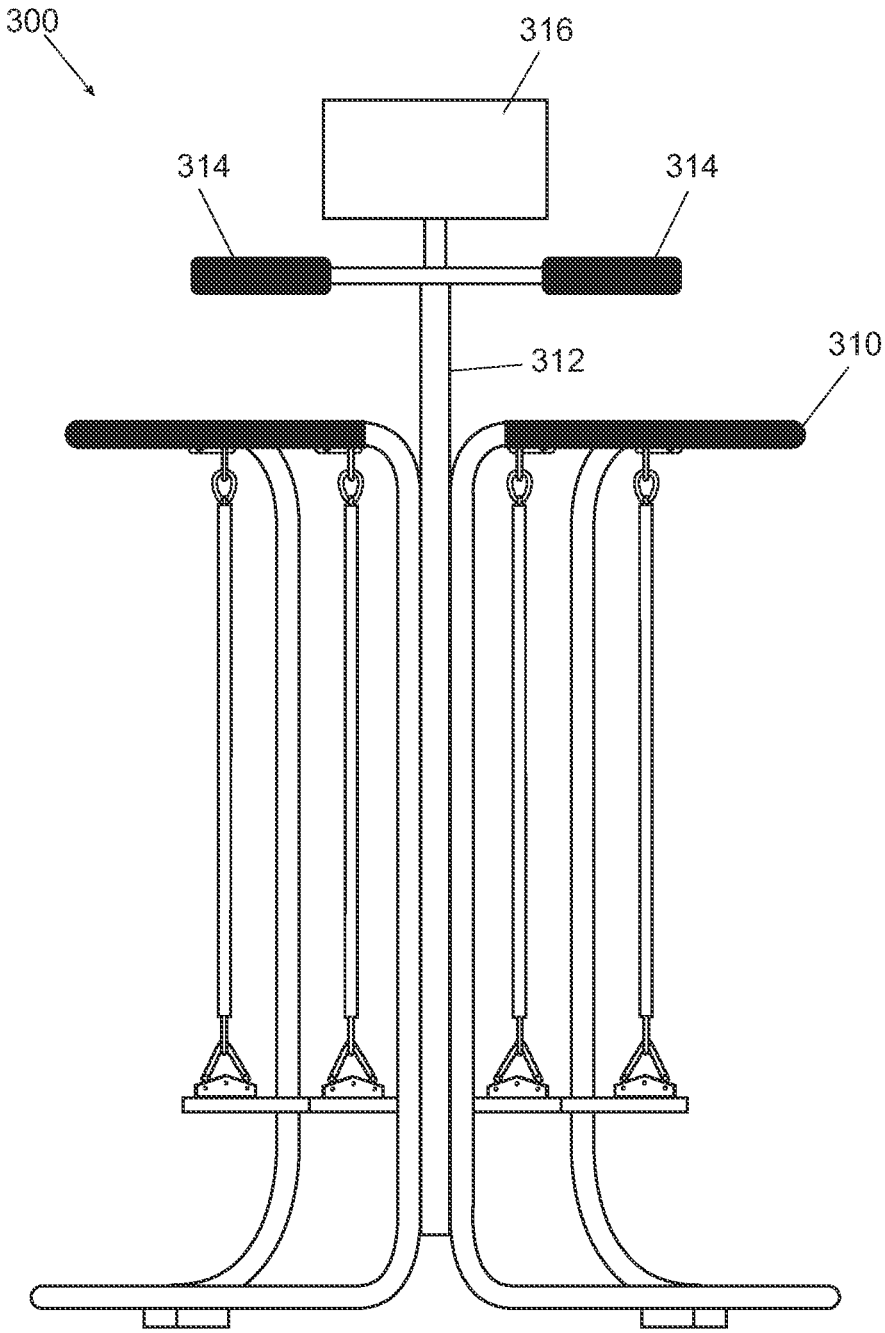
FIGS. 8*a*-8*c*, depict another preferred embodiment of the present invention.
Figure 8B:
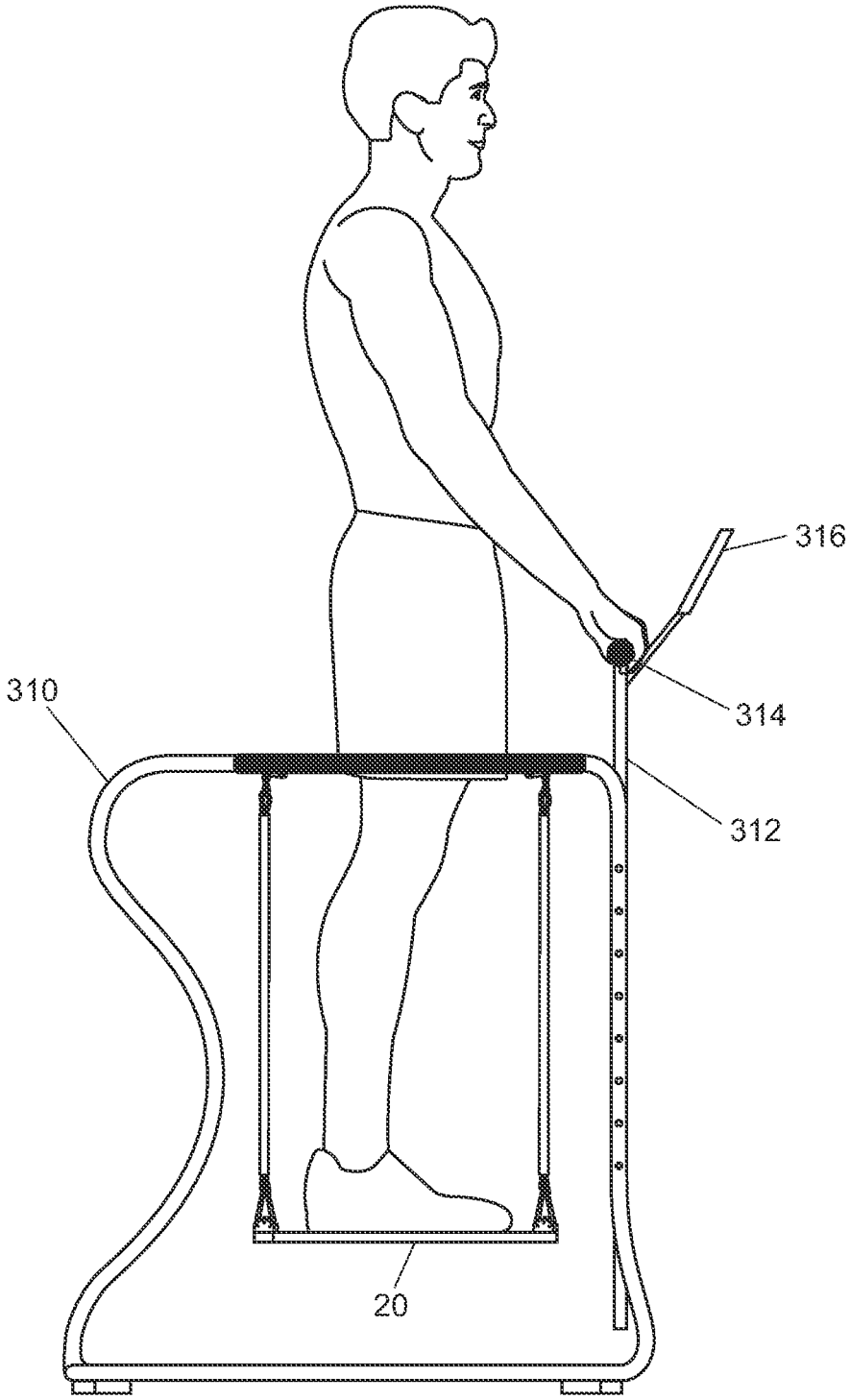
Figure 8C:
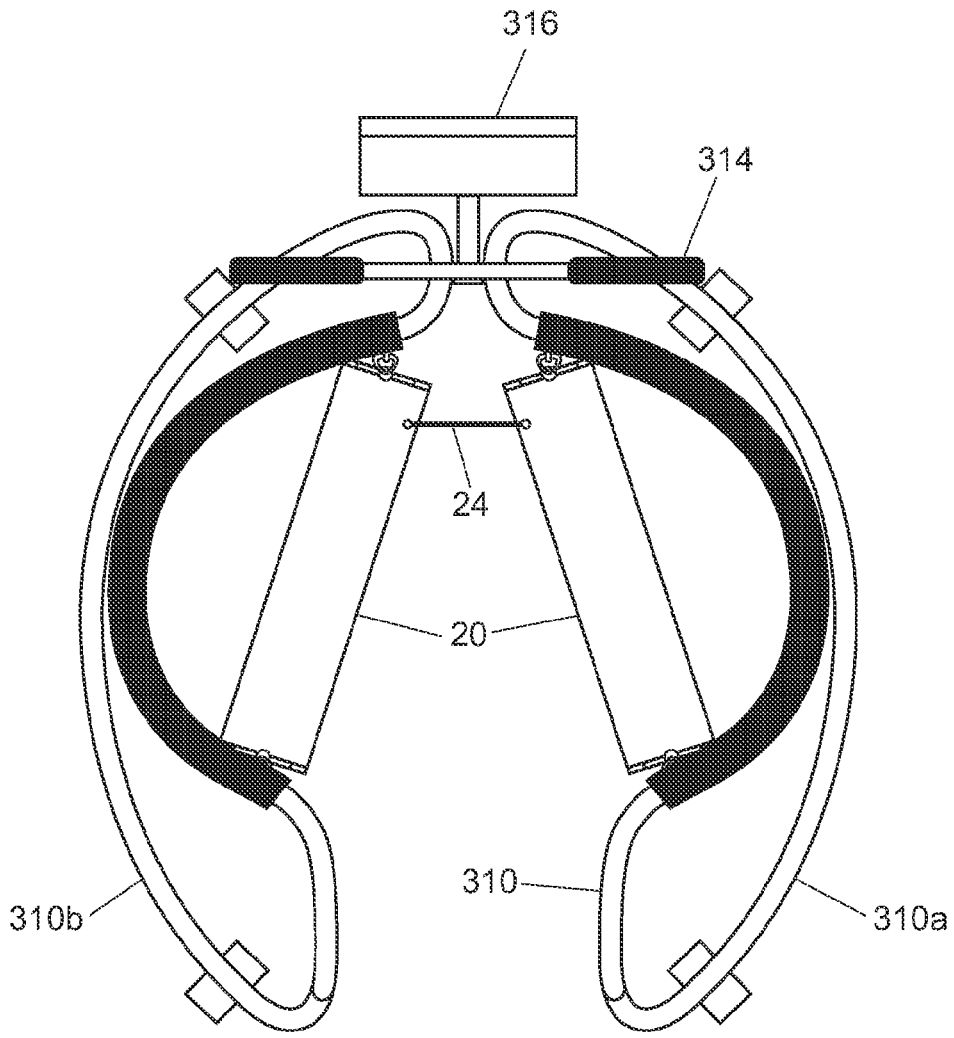

FIG. 8 illustrates still another embodiment of exercise apparatus according to the present invention which employs the same hanging foot platform concept as has been described heretofore. For this embodiment, FIG. 8*a* shows a front view, FIG. 8*b* shows a side view and FIG. 8*c* shows a top view of the exercise apparatus 300.

As illustrated, the apparatus includes a stand 310 which supports the foot platforms 20, in the manner described above, as well as a vertical member 312 to which are attached horizontal handles 314 and an exercise chart 316.

The foot platforms 20 are slanted toward each other at the front to create the "pigeon-toe" effect described above in connection with FIGS. 7*d* and 7*e*.

Advantageously, the main support or stand 310 is formed of a frame made in two pieces, a right side 310*a* and left side 310*b*, respectively, as shown in FIG. 8*c*.

A cord or rod 24 is connected between the foot platforms. Preferably this connecting member is elastic, such as a rubber band, a bungee cord, a spring or the like.

In still another embodiment, the exercise apparatus 100 can be adapted to be used by a physically challenged person. A person having a disabled leg can rest the disabled leg on a foot rest mounted on the apparatus and perform the exercise with the other leg. Also, the exercise apparatus can be designed to be used by a person in a wheelchair. The user can perform upper body exercise by attaching an add-on to the main frame 10, as shown in FIGS. 2*a*, 2*b* and 3. A locking device can be provided to lock the wheelchair of the user to avoid movement of the wheelchair while the user is performing the exercise. Various other alterations in the design of the equipment can be made to help a physically challenged person in performing several types of exercises without changing the scope of the invention.

In still another embodiment, one or more sensors can be disposed within the exercise apparatus 100. The sensors can be integrated with a screen display (not shown) for interactive use in a manner well known in the art. The sensors can be used to sense the heartbeat rate or other body conditions of the user in order to display these conditions on a screen and to notify the user about his/her physical health status. Various other types of sensors, such as the motion sensors 22*a* and 22*b* shown in FIG. 5*a*, can also be used for information transfer between the exercise device and the user.

In still another embodiment, the exercise apparatus 100 can be equipped with electricity generating means to convert the physical energy of the user into electrical energy. Generated electrical energy can be used to power the electronic systems of the exercise apparatus 100; that is, the sensors, monitors and displays and the like.

While certain embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the following claims.

What is claimed is:

1. An exercise apparatus for training the body of a user in multi-directional patterns, said exercise apparatus comprising:

a support having a plurality of connecting points;

two foot platforms adapted to be attached to and hang from said connecting points in side by side arrangement to support a user, each of said foot platforms being adapted for movement in a substantially horizontal X-Y plane with at least two degrees of freedom;

an at least one vertical elongate hanging member, connecting each of said foot platforms to at least one of said connecting points on said support, allowing said movement of said foot platforms in said X-Y plane with said at least two degrees of freedom; and an at least one substantially horizontal elongate connecting member, connecting said two foot platforms together.

2. The exercise apparatus according to claim 1, wherein said two foot platforms are elongate and hang side by side substantially in parallel relationship.

3. The exercise apparatus according to claim 1, wherein said two foot platforms are elongate and hang side by side, with one end of said two platforms closer together than an opposite end thereof.

4. The exercise apparatus according to claim 1, wherein said two foot platforms are elongate and have two opposite ends, and wherein said connecting member connects said foot platforms together substantially midway between their two ends.

5. The exercise apparatus according to claim 1, wherein said two foot platforms are elongate and have two opposite ends, and wherein said connecting member connects said foot platforms together adjacent one of their two ends.

6. The exercise apparatus according to claim 1, wherein said two foot platforms are elongate and have two opposite ends, and wherein one of said connecting members interconnects said foot platforms together adjacent at each of their two ends.

7. The exercise apparatus according to claim 1, wherein said two foot platforms are elongate and have two opposite ends, and wherein said connecting member connects said foot platforms together diagonally from one end of one platform to an opposite end of the other.

8. The exercise apparatus according to claim 1, wherein the connecting member is adjustable in length.

9. The exercise apparatus according to claim 1, wherein the connecting member is flexible and is selected from the group consisting of a cord, a chain, a strap, a cable, a band, a spring, a piston and cylinder, a web and a sheet.

10. The exercise apparatus according to claim 9, wherein said web or said sheet extends between adjacent edges of said two platforms.

11. The exercise apparatus according to claim 1, wherein the connecting member is elastic.

12. The exercise apparatus according to claim 1, wherein the connecting member is inflexible and rigid.

13. The exercise apparatus according to claim 9, wherein the piston and cylinder provide at least one of hydraulic and pneumatic resistance in at least one direction.

14. The exercise apparatus according to claim 13, wherein the piston and cylinder are spring biased in at least one direction.

15. The exercise apparatus according to claim 1, comprising a single hanging member connecting each foot platform to the support.

16. The exercise apparatus according to claim 15, wherein each connecting member is pivotally attached to a respective foot platform.

17. The exercise apparatus according to claim 1, wherein said at least one hanging member is adjustable in length.

18. The exercise apparatus according to claim 1, which comprises two hanging members for attaching opposite ends of the foot platform to said support.

19. The exercise apparatus according to claim 1, wherein said hanging member is a tension element selected from the group consisting of a chain, a band, a rod, a tube, a strap, a cable, a spring and a combination of at least two such tension elements.

20. The exercise apparatus according to claim 19, wherein said tension element is non-elastic.

21. The exercise apparatus according to claim 19, wherein at least a portion of said tension element is elastic, thereby supporting said foot platform with a third degree of freedom.

22. The exercise apparatus according to claim 19, wherein said tension element is flexible.

23. The exercise apparatus according to claim 19, wherein said tension element is a solid, non-flexible member.

24. The exercise apparatus according to claim 1, wherein said support is a holding bar which is C-shaped and arranged in a substantially horizontal plane.

25. The exercise apparatus according to claim 24, wherein said hanging member for attaching said foot platform to said holding bar has a ring at one end adapted to slide over said holding bar to form a connecting point.

26. The exercise apparatus according to claim 24, wherein said hanging member for attaching said foot platform to said holding bar has a clip at one end for attachment to said holding bar at a connecting point.

27. The exercise apparatus according to claim 1, wherein said hanging members are detachable from said support.

28. The exercise apparatus according to claim 1, wherein said two platforms are substantially horizontal.

29. The exercise apparatus according to claim 1, wherein one end of said two platforms is lower than an opposite end thereof.

30. The exercise apparatus according to claim 29, wherein a front end of said two platforms for supporting a front of a user's foot is lower than a rear end for supporting a user's heel.

31. The exercise apparatus according to claim 1, wherein the support is provided with a plurality of connecting points for each hanging member so that the user can select the positions of the foot platforms by selecting the connecting points to which the respective hanging members are attached.

32. An exercise apparatus for training the body of a user in multi-directional patterns, said exercise apparatus comprising:

a support having a plurality of connecting points;

two elongate and substantially identical foot platforms adapted to be attached to and hang from said connecting points in a side by side arrangement to support a user, each of said foot platforms being adapted for movement in a substantially horizontal X-Y plane with at least two degrees of freedom, and each of said foot platforms having one end for supporting a front of a user's foot and an opposite end for supporting a heel of a user's foot; and an at least one vertical elongate hanging member, connecting each of said foot platforms to at least one of said connecting points on said support, allowing said movement of said foot platforms in said X-Y plane with said at least two degrees of freedom, said hanging members supporting said foot platforms such that, hanging free and without the application of force by a user's foot, the distance between the front ends of the two platforms is substantially different than the distance between the rear ends of the platforms.

33. The exercise apparatus defined in claim 32, wherein the distance between the front ends of the platforms is less than the distance between the rear ends of the platforms.

34. The exercise apparatus according to claim 32, wherein said two foot platforms hang side by side substantially in parallel relationship.

35. The exercise apparatus according to claim 32, wherein said two foot platforms hang side by side, with one end of said two platforms closer together than an opposite end thereof.

36. The exercise apparatus according to claim 32, wherein said connecting member connects said foot platforms together substantially midway between their two ends.

37. The exercise apparatus according to claim 32, wherein said connecting member connects said foot platforms together adjacent one of their two ends.

38. The exercise apparatus according to claim 32, wherein said connecting member connects said foot platforms together diagonally from one end of one platform to an opposite end of the other.

39. The exercise apparatus according to claim 32, wherein one of said connecting members connects said foot platforms together adjacent at each of said two ends.

40. The exercise apparatus according to claim 32, wherein the connecting member is adjustable in length.

41. The exercise apparatus according to claim 32, wherein the connecting member is flexible and is selected from the group consisting of a cord, a chain, a strap, a cable, a band, a spring, a piston and cylinder, a web and a sheet.

42. The exercise apparatus according to claim 41, wherein said connecting member is a sheet that extends between adjacent edges of said two platforms.

43. The exercise apparatus according to claim 41, wherein the connecting member is elastic.

44. The exercise apparatus according to claim 32, wherein the connecting member is inflexible and rigid.

45. The exercise apparatus according to claim 41, wherein the piston and cylinder provide at least one of hydraulic and pneumatic resistance in at least one direction.

46. The exercise apparatus according to claim 45, wherein the piston and cylinder are spring biased in one direction.

47. The exercise apparatus according to claim 32, comprising a single hanging member connecting each foot platform to the support.

48. The exercise apparatus according to claim 47, wherein each connecting member is pivotally attached to a respective foot platform.

49. The exercise apparatus according to claim 32, wherein said at least one hanging member is adjustable in length.

50. The exercise apparatus according to claim 32, which comprises two hanging members for attaching opposite ends of the foot platform to said support.

51. The exercise apparatus according to claim 32, wherein said hanging member is a tension element selected from the group consisting of a chain, a band, a rod, a tube, a strap, a cable, a spring and a combination of at least two such tension elements.

52. The exercise apparatus according to claim 51, wherein said tension element is non-elastic.

53. The exercise apparatus according to claim 51, wherein at least a portion of said tension element is elastic, thereby supporting said foot platform with a third degree of freedom.

54. The exercise apparatus according to claim 51, wherein said tension element is flexible.

55. The exercise apparatus according to claim 51, wherein said tension element is a solid, non-flexible member.

56. The exercise apparatus according to claim 32, wherein said support is a holding bar which is C-shaped and arranged in a substantially horizontal plane.

57. The exercise apparatus according to claim 56, wherein said hanging member for attaching said foot platform to said holding bar has a ring at one end adapted to slide over said holding bar to form a connecting point.

58. The exercise apparatus according to claim 56, wherein said hanging member for attaching said foot platform to said holding bar has a clip at one end for attachment to said holding bar at a connecting point.

59. The exercise apparatus according to claim 32, wherein said hanging member is detachable from said support.

60. the exercise apparatus according to claim 32, wherein said two platforms are substantially horizontal.

61. The exercise apparatus according to claim 32, wherein one end said two platforms is lower than an opposite end thereof.

62. The exercise apparatus according to claim 61, wherein a front end of said two platforms for supporting a front of a user's foot is lower than a rear end for supporting a user's heel.

63. The exercise apparatus according to claim 32, wherein the support is provided with a plurality of connecting points for each hanging member so that the user can select the positions of the foot platforms by selecting the connecting points to which the respective hanging members are attached.

64. An exercise apparatus for training the body of a user in multi-directional patterns, said exercise apparatus comprising:

a support having a plurality of connecting points;

two elongate and substantially identical foot platforms adapted to be attached to and hang from said connecting points in a side by side arrangement to support a user, each of said foot platforms being adapted for movement in a substantially horizontal X-Y plane with at least two degrees of freedom;

an at least one vertical elongate hanging member, connecting each of said foot platforms to at least one of said connecting points on said support, allowing said movement of said foot platforms in said X-Y plane with said at least two degrees of freedom;

a plurality of tethers, at least one tether connecting a respective one of said platforms with a fixed point adjacent said platforms, thereby to limit the movement of said platforms.

65. The exercise apparatus defined in claim 64, comprising two tethers for each platform, each tether connecting one end of a respective platform with a fixed point.

66. The exercise apparatus defined in claim 64, wherein the tethers are adjustable in length.

67. The exercise apparatus according to claim 64, wherein the tethers are flexible and are selected from the group consisting of a cord, a chain, a strap, a cable, a band, a spring and a piston and cylinder.

68. The exercise apparatus according to claim 64, wherein the tethers are elastic.

69. The exercise apparatus according to claim 64, wherein the tethers are inflexible and rigid.

70. The exercise apparatus according to claim 64, wherein said fixed point is located beneath each platform, and one of said tethers connects each respective platform to the fixed point beneath it.

* * * * *